US005282456A

United States Patent [19]

Smelcer et al.

[11] Patent Number: 5,282,456

[45] Date of Patent: Feb. 1, 1994

[54] HIGH EFFICIENCY FUEL FIRED INDUCED DRAFT CONDENSING FURNACE WITH HORIZONTAL PLASTIC VENT TERMINATION ASSEMBLY

[75] Inventors: Jim C. Smelcer; Jack H. Weaver, both of Fort Smith, Ark.

[73] Assignee: Rheem Manufacturing Company, New York, N.Y.

[21] Appl. No.: 899,733

[22] Filed: Jun. 17, 1992

[51] Int. Cl.[5] ..... F24C 3/00

[52] U.S. Cl. ..... 126/85 B; 126/110 R; 454/231; 52/220.8

[58] Field of Search ..... 126/85 B, 112, 99 R, 126/80, 77, 307 R, 312, 314–317; 454/3, 4, 8, 171, 237, 238, 241, 252; 52/302, 244, 220

[56] References Cited

U.S. PATENT DOCUMENTS

| | | | |
|---|---|---|---|
| 2,711,683 | 6/1955 | Ryder | 98/48 |
| 2,764,972 | 10/1956 | Ryder | 126/307 |
| 2,966,838 | 7/1958 | Thompson et al. | 98/62 |
| 2,998,764 | 9/1961 | Bedell et al. | 98/62 |
| 3,052,230 | 9/1962 | Conrad | 126/307 |
| 3,105,432 | 10/1963 | Chamberlain | 98/62 |
| 3,136,309 | 6/1964 | Martz | 126/85 |
| 3,199,504 | 8/1965 | Morin, Jr. et al. | 126/91 |
| 3,428,040 | 2/1969 | Baker et al. | 126/110 |
| 3,435,816 | 4/1969 | DeWerth | 126/85 |
| 3,550,579 | 12/1970 | Baker | 126/85 B X |
| 3,601,116 | 8/1971 | Davis et al. | 126/110 |
| 3,765,823 | 10/1973 | Kawabata et al. | 431/157 |
| 4,622,947 | 11/1986 | Hays et al. | 126/110 R |
| 4,699,317 | 10/1987 | Childs | 126/110 R |
| 5,016,609 | 5/1991 | Shimek et al. | 126/85 B |
| 5,062,409 | 11/1991 | Kamanaka et al. | 126/110 R X |

OTHER PUBLICATIONS

Lennox Industries, Inc., Installation Instruction Pub. "G14/GSR14 Exhaust/Intake Air Termination Kits".

Weil-McClain Supplemental Instructions Pub."GV Boiler Sidewall Venting".

*Primary Examiner*—Larry Jones

*Attorney, Agent, or Firm*—Konneker Bush & Hitt

[57] ABSTRACT

A high efficiency fuel-fired induced draft condensing furnace is provided with a horizontal vent termination assembly installed in an exterior wall of a building served by the furnace. The vent termination assembly, constructed entirely from PVC plastic pipe and fittings, includes a combustion gas vent pipe connected to the furnace's draft inducer fan outlet, horizontally extending through an opening in the wall, and having an open discharge end positioned outwardly beyond the wall. A larger diameter combustion air inlet pipe circumscribes the vent pipe within the wall opening and forms around the vent pipe an annular combustion air flow passage that is communicated with the furnace combustion air inlet. A coupling member connected to the outer end of the inlet pipe has a diametrically enlarged end portion positioned on the outside surface of the wall, axially inwardly of the outer vent pipe, and forming an annular inlet to the flow passage between the two pipes. The outer end of the vent pipe is left uncovered so as to permit direct, unimpeded axially outward discharge therefrom of furnace combustion gases. In a similar fashion, the enlarged end portion of the coupling member is left uncovered so as to permit direct, unimpeded axially inward entry therethrough of outside combustion air. Because the open outer ends of the concentric coupling and vent face in the same axial direction, the operating pressure differential across the furnace heat exchanger is substantially unaffected by changes in outside wind velocity and direction.

16 Claims, 2 Drawing Sheets

HIGH EFFICIENCY FUEL FIRED INDUCED DRAFT CONDENSING FURNACE WITH HORIZONTAL PLASTIC VENT TERMINATION ASSEMBLY

BACKGROUND OF THE INVENTION

The present invention generally relates to fuel fired heating appliances, and more particularly relates to air intake and combustion products venting apparatus for high efficiency, fuel fired, induced draft condensing furnaces utilizing direct vents.

Direct vented fuel-fired heating appliances, such as furnaces serving indoor conditioned spaces, have sealed combustion chambers that require appliance intake air and flue gases to be passed through venting systems extended to an outdoor location and terminating within the same outdoor pressure zone.

The combustion systems of modern high efficiency, fuel fired, induced draft condensing furnaces typically include a heat exchanger structure formed from series-connected primary and secondary heat exchanger sections. A fuel/air burner structure is operatively connected to the inlet of the primary heat exchanger, and the inlet of draft inducer fan is coupled to the outlet of the secondary or "condensing" heat exchanger. During operation of the furnace, a fuel/air mixture is delivered to the burner structure which burns the mixture and flows the resulting flames and hot combustion gases into the inlet of the primary or "upstream" heat exchanger section.

At the same time, the draft inducer fan draws the hot combustion gases sequentially through the primary and secondary heat exchanger sections, and then discharges the combustion gases. During this combustion products flow process, supply air to be heated and delivered to a conditioned space served by the furnace is forced externally across the heat exchanger structure to receive combustion heat therefrom.

To supply combustion air to the furnace, and vent combustion gases discharged therefrom to the exterior of the building served by the furnace, it is conventional to respectively extend inlet and vent pipes from the burner structure inlet and the draft inducer fan outlet horizontally outwardly through an exterior wall of the building, or vertically through the roof of the building. Accordingly, during furnace operation the draft inducer fan simultaneously draws outside combustion air through the inlet pipe to the burner structure, and discharges cooled, moisture laden combustion gases (at approximately 120° F.) through the vent pipe to the exterior of the building. Due to the corrosive nature of the cooled combustion gases discharged from a high efficiency condensing furnace of this general type, a preferred material for constructing the overall inlet and vent piping system therefor has been PVC (polyvinyl chloride) plastic pipe.

In horizontal venting and inlet applications, it has been conventional practice to extend the plastic inlet and vent pipes outwardly through the exterior building wall in a relatively close side-by-side relationship, with a vent termination cap structure secured to the exterior ends of the pipes. The cap structure functions to create an axial discharge of the combustion gases and a radial intake of the combustion air to thereby inhibit undesirable short circuiting of the closely adjacent intake and discharge flows at the outer ends of the pipes. In an alternative prior art arrangement the two side-by-side pipes are more widely spaced apart, with the exterior vent pipe portion projecting further away from the exterior building wall than the inlet pipe, and the cap structure is eliminated.

Each of these conventional intake and vent pipe arrangements is subject to several well known and heretofore unsolved problems. One such problem is the tendency of the outer end of the inlet pipe to ice up, and become blocked, during freezing weather due to its proximity to the considerable moisture being discharged with the cooled combustion gases through the adjacent vent pipe. Another problem flows from the tendency of varying outdoor wind velocities and directions to cause undesirable fluctuations in the internal pressure differential across the heat exchanger which, in turn, can adversely affect the venting capabilities of the furnace. This pressure differential fluctuation arises in instances where, due to the outer end geometry of the vent and inlet pipe structure, the outdoor wind pressure at the outer end of the vent pipe is greater or larger than the wind pressure on the outer end of the inlet pipe.

In an attempt to improve the performance of the overall venting and intake system, it has previously been proposed to extend the vent pipe concentrically through a larger diameter inlet pipe passing through the exterior building wall, and to provide the outer end of the larger diameter inlet with a rain shield structure. During operation of this concentric vent termination structure, the cooled combustion gases are axially discharged from the vent pipe, and the incoming combustion air enters the termination assembly in a radial direction through the rain shield structure.

While this prior art concentric vent termination structure tends to alleviate the problem of inlet opening freeze-up, it still tends to create undesirable pressure differential deviations between the inlet and outlet sides of the furnace heat exchanger in response to variations in the outdoor wind velocity and/or direction.

From the foregoing it can be seen that a need exists for an improved horizontal vent termination assembly, for use in conjunction with high efficiency condensing furnaces of the general type described above, which eliminates or at least substantially reduces the above-mentioned problems typically associated with conventionally constructed and configured vent termination assemblies. It is accordingly an object of the present invention to provide such an assembly.

SUMMARY OF THE INVENTION

In carrying out principles of the present invention, in accordance with a preferred embodiment thereof, a high efficiency fuel fired induced draft furnace is operatively connected to a horizontal vent termination assembly installed in a single opening extending through an exterior wall of a building served by the furnace. The vent termination assembly is preferably of a plastic construction and includes combustion gas vent pipe means for receiving and ejecting combustion gases discharged from the furnace draft inducer fan. The combustion gas vent pipe means have an inlet end connected to the furnace draft inducer fan, and an open, horizontally outwardly facing discharge end positioned outwardly beyond the outside surface of the exterior building wall, the open discharge end being uncovered so as to permit direct, unimpeded axially outward discharge of combustion gases therethrough to the outside of the building.

Combustion air inlet pipe means are concentrically disposed outwardly around the combustion gas vent pipe means within the wall opening and define with the combustion gas vent pipe means an annular flow space operative to receive a horizontally inward flow of outside combustion air and communicated with the air inlet of the furnace burner structure. The combustion air inlet pipe means have an open inlet end outwardly circumscribing the combustion gas vent pipe means, axially inwardly of the open discharge end thereof, and positioned outwardly adjacent the outside surface of the wall to receive an inflow of outside combustion air into the annular flow space. The open inlet end of the combustion air inlet pipe means are uncovered so as to permit a direct, unimpeded axially inward flow of outside combustion air therethrough.

During operation of the furnace, the draft inducer fan creates an operating pressure differential across the combustion heat exchanger portion of the furnace. Because the open, uncovered ends of the combustion gas vent pipe means and the combustion air inlet pipe means face in the same axial direction, this operating pressure differential, and thus the venting performance of the furnace, is substantially unaffected by changes in outside wind direction and velocity.

In an illustrated preferred embodiment thereof, the vent termination assembly of the present invention is formed entirely from PVC plastic pipe and associated fittings, thereby permitting the assembly to be rapidly fabricated and installed at a relatively low cost. The assembly requires only a single opening in the exterior wall, and heat radially outwardly generated from the inner combustion gas vent means conveniently serves to prevent ice-up of the combustion air inlet opening during freezing weather. Additionally, in fabricating the assembly, its inner and outer PVC pipe sections may easily cut to the necessary lengths to match the thickness of particular outside wall within which the assembly is operatively installed.

DETAILED DESCRIPTION

Figure 1:
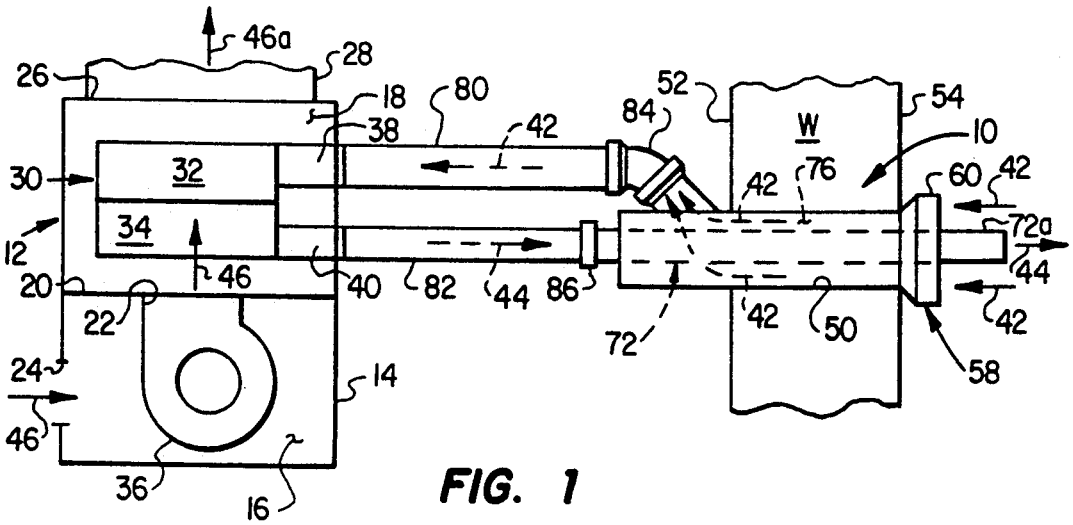
FIG. 1 is a schematic illustration of a high efficiency fuel fired induced draft condensing furnace operatively connected to a horizontal plastic vent termination assembly embodying principles of the present invention.

As schematically depicted in FIG. 1, the present invention provides an improved vent termination assembly 10 for use in conjunction with a high efficiency, fuel-fired induced draft condensing furnace 12. Furnace 12 is located in a suitable interior building area having an outside wall W, and has a housing 14 vertically divided into a return plenum 16 and a heat exchanger chamber 18 by a horizontal interior panel 20 having a central opening 22 therein. An inlet opening 24 is formed in the bottom section of the housing 14, and an outlet opening 26, connected to suitable supply air ductwork 28, is formed in the top section of the housing.

A heat exchanger structure 30, having an upper primary section 32 connected in series to a lower secondary section 34, is supported in the upper chamber 18, and a supply air blower 36 is positioned in plenum 16 and has its outlet connected to the divider panel opening 22. A fuel/air burner structure 38 is operatively connected to the inlet of the primary heat exchanger section 32, and a draft inducer fan 40 has its inlet connected to the outlet of the secondary heat exchanger section 34.

During operation of the furnace 12, the burner structure 38 receives combustion air 42, and fuel from a source thereof (not shown), burns the received fuel/air mixture, and flows flames and resulting hot combustion gases into the inlet of the primary heat exchanger section 32. The draft inducer fan 40 draws the combustion gases sequentially through the primary and secondary heat exchanger sections 32,24 and then discharges the cooled combustion gases 44 at a discharge temperature of about 120° F. Return air 46 from the conditioned space served by the furnace 12 is drawn into the plenum 16, via the inlet opening 24, by the blower 36 and then forced upwardly across the heat exchanger structure 30 to create heated supply air **46*a* which is delivered to the conditioned space through the supply ductwork 28**.

Figure 2:
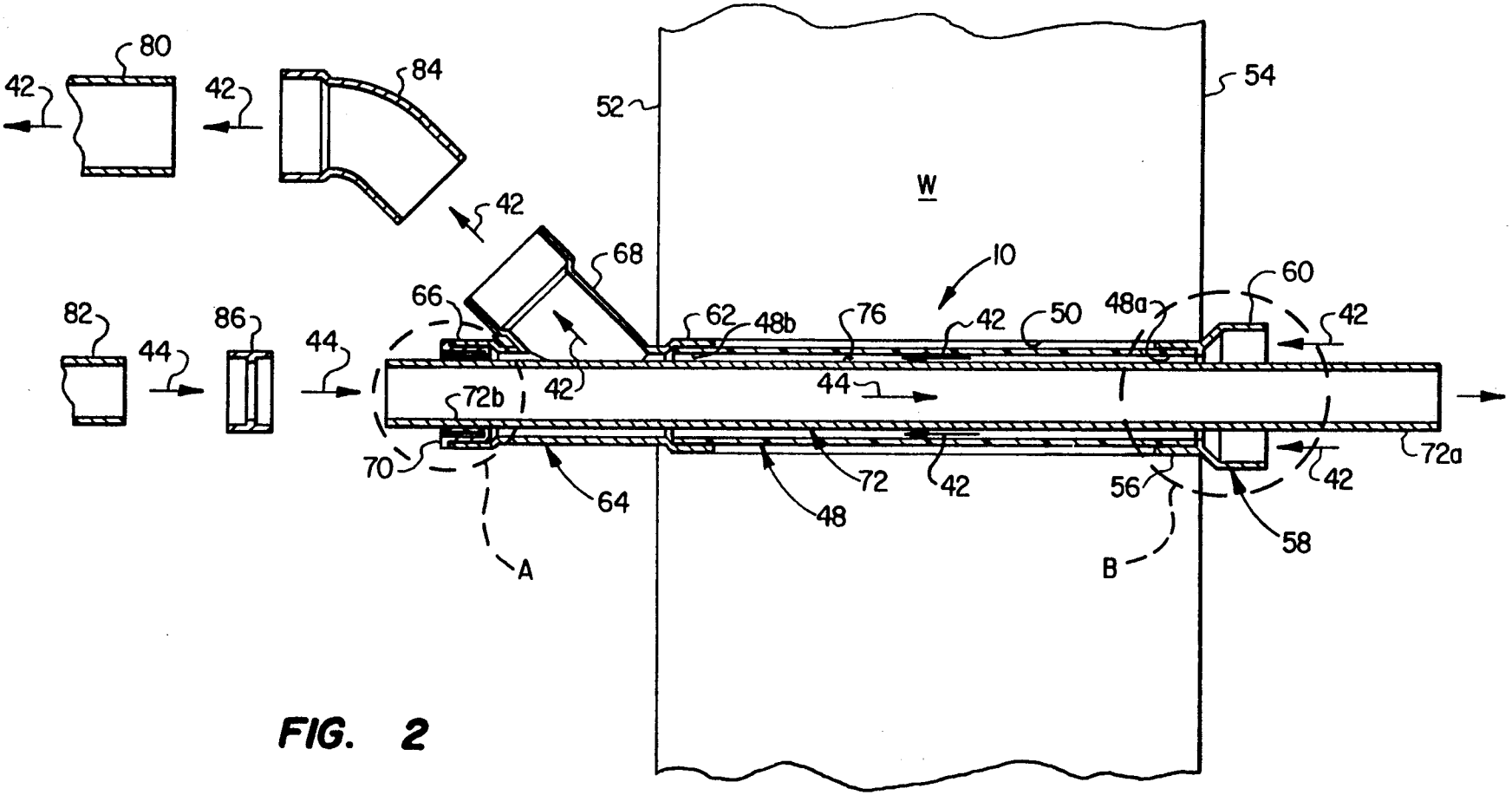
FIG. 2 is an enlarged scale cross-sectional view through the vent termination assembly.

Referring now to FIG. 2, according to a feature of the present invention, the vent termination assembly 10 is conveniently and inexpensively formed entirely from standard PVC (polyvinyl chloride) plastic pipe and fittings and includes a length of combustion air inlet pipe 48 which is extended through an appropriately sized circularly cross-sectioned opening 50 passing perpendicularly through the exterior wall W from its inside surface 52 to its outside surface 54. The open right or outer end **48*a* of pipe 48 is generally flush with the outside surface 54 of wall W, while the left or inner end 48*b* of pipe 48 projects leftwardly beyond the inside surface 52** of the wall.

The outer end **48*a* of pipe 48, which is representatively a 3" diameter type SDR 26 PVC pipe, is cemented within the smaller end 56 of a 3"×4" PVC coupling 58 which has been slightly modified as later described herein. As illustrated, the open larger diameter end 60 of the coupling 58 projects outwardly beyond the exterior outside wall surface 54. The inner end 48*b* of the pipe 48 is cemented within one end 62 of a 3"×3"×3" PVC wye fitting 64 having an opposite end 66 and an angled side portion 68 positioned above the balance of the wye fitting and sloping outwardly toward its left end 66. A 2"×3" PVC reducing bushing 70, slightly modified as subsequently described herein, is cemented within the end portion 66 of the wye fitting 64**.

A length of 2" diameter schedule 40 PVC pipe 72 coaxially extends through the interior of the outer pipe 48, with the right or outer end **72*a* of pipe 72 projecting outwardly beyond the open outer end of coupling 58, and approximately 10" to the right of the exterior side surface 54 of wall W. The opposite end portion 72*b* of the inner pipe 72 extends through and is cemented within the interior of the reducing bushing 70, and projects leftwardly beyond the bushing 70** as illustrated.

To permit the inner pipe 72 to be extended through the bushing 70 as indicated, the annular interior stop portion 74 of the bushing (shown in phantom in FIG. 3) formed integrally with the bushing during its manufacture is machined away prior to installing the bushing in the wye fitting end 66 and extending the inner pipe 72 through the bushing.

It can be seen in FIG. 2 that the horizontally oriented outer and inner pipes 48,72 define therebetween a flow annulus 76 that communicates at its left end with the interior of the angled side portion 68 of the wye fitting 64. In order to assure that the annulus 76 is communicated at its right end with the interior of the larger open end portion 60 of the coupling 58, most of the annular interior stop portion 78 of the coupling (shown in phantom in FIG. 4) is machined away prior to installing the coupling 58 on the right end 48*a* of the outer pipe 48.

Referring now to FIGS. 1 and 2, the vent termination assembly 10 is connected to the furnace 12 using PVC plastic intake and vent branch pipes 80 and 82. The left end of the intake pipe 80 is appropriately connected to the inlet of the burner structure 38, and the right end of the intake pipe 80 is connected to the angled side portion 68 of the wye fitting 64 using a PVC plastic street el fitting 84. The left end of the vent pipe 82 is appropriately connected to the outlet of the draft inducer fan 40, and the right end of the vent pipe 82 is connected to the left end 72*b* of the inner vent termination assembly pipe 72 using a PVC plastic coupling 86.

During operation of the furnace 12, the draft inducer fan 40 draws outside combustion air 42 into the burner structure 38 sequentially through the open right end 60 of the coupling 58, the flow annulus 76, and the branch pipe 80. At the same time, the draft inducer fan 40 discharges cooled combustion gases 44 sequentially through the pipe branch pipe 82 and the combustion gas vent pipe 72. The diametrically widened coupling portion 60 functions to advantageously reduce the intake air velocity at the entrance to the assembly 10.

According to an important feature of the invention, since the uncovered open inlet end 60 of the coupling 58 and the uncovered open discharge end 72*a* of the inner pipe 72 axially face in the same direction, the external wind loads on these two open pipe ends are essentially equalized. Accordingly, variations in outside wind velocity and/or direction do not appreciably affect the operation of the draft inducer fan 40 by varying the sensitive relationship between the pressure at the burner structure inlet and the draft inducer fan outlet.

For example, in the event of a sudden leftwardly directed wind load on the exterior portion of the vent termination assembly 10, the resulting pressure increase at the burner structure inlet tends to be precisely offset by the resulting pressure increase at the draft inducer fan outlet, thereby desirably maintaining the net operating pressure differential across the heat exchanger structure 30 essentially constant. Due to the unique structure and configuration of the exterior portion of the vent termination assembly 10, this net pressure differential across the heat exchanger structure 30, and thus the venting performance of the furnace 12, is maintained essentially constant during furnace operation despite wide variations in outside wind direction and velocity.

In addition to this feature of the invention, the vent termination assembly 10 provides a variety of additional advantages over conventional vent and intake structures previously used in conjunction with high efficiency condensing furnaces. For example, unlike conventional condensing furnace venting practice in which separate side-by-side PVC plastic vent and inlet pipes are extended through separate holes formed in an exterior building wall, in the present invention only one hole needs to be formed through such wall.

Additionally, using the concentric inlet/vent pipe arrangement of the assembly 10, exhaust gas heat from the inner pipe 72 substantially prevents potential ice-up of the concentrically disposed assembly inlet opening in freezing weather. This ice-up problem is aggravated by the fact that in high efficiency condensing furnaces the discharged combustion gases are relatively cool and contain substantial amounts of moisture, and the problem has not, to the present applicants' knowledge, been satisfactorily solved using side-by-side PVC plastic vent and inlet pipes.

Figure 3:
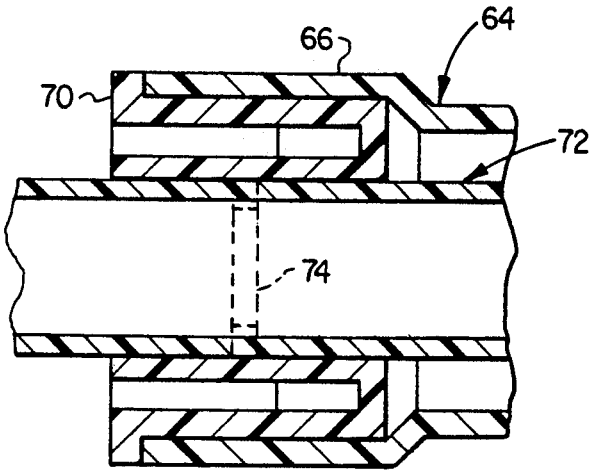
FIG. 3 is an enlargement of the circled area "A" in FIG. 2.
Figure 4:
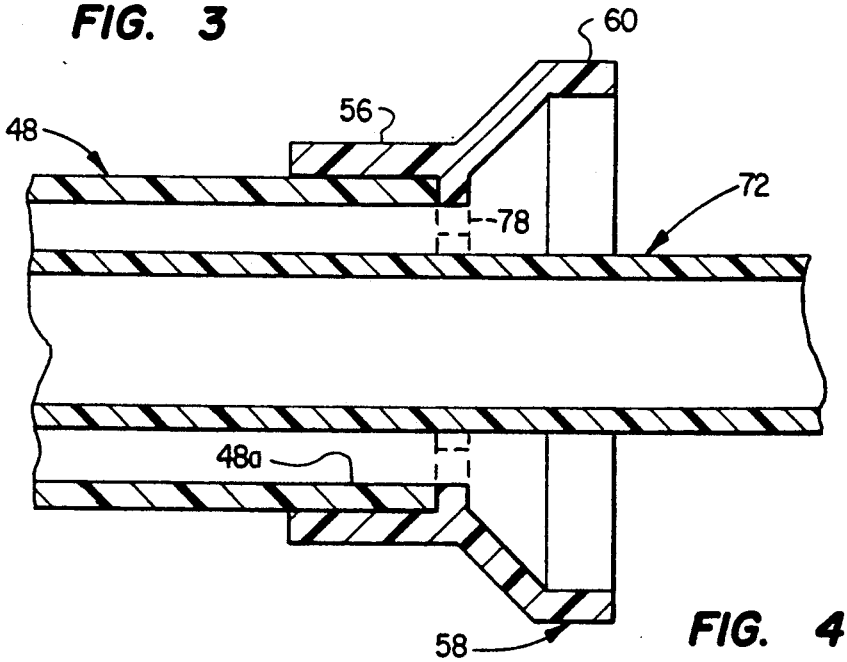
FIG. 4 is an enlargement of the circled area "B" in FIG. 2.

In addition to providing a high degree of resistance to the corrosive characteristics of the low temperature combustion discharge gases 44, the use of PVC plastic to form the vent termination assembly 10 substantially decreases the overall fabrication cost thereof compared, for example, to concentric metal vent/inlet assemblies customarily used on non-condensing type furnaces. This is due to the fact that, as previously described herein, the vent termination assembly 10 may be conveniently and quickly fabricated entirely from standard, commercially available PVC plastic pipe and fittings—only minor modifications to the fittings 58 and 70, as shown in FIGS. 3 and 4, are required.

The substantial cost savings associated with the vent termination assembly 10 are further enhanced by the fact that it is not necessary to provide the exterior portion of the assembly 10 (e.g., the coupling portion 60 and the outer pipe end portion 72*a*) with complicated hoods, baffles, deflectors and the like. The open, uncovered assembly portions 60,72*a* create direct, unimpeded axial venting and inlet paths that provide the aforementioned pressure differential maintenance without the necessity of such hoods, baffles and deflectors.

The foregoing detailed description is to be clearly understood as being given by way of illustration and example only, the spirit and scope of the present invention being limited solely by the appended claims.

What is claimed is:

1. Apparatus for heating at least a portion of a building having an exterior wall, said apparatus comprising:

a fuel-fired induced draft furnace disposed in said building and including:

heat exchanger means for receiving an internal throughflow of hot combustion gases, said heat exchanger means having an inlet and an outlet, fuel burner means for receiving a fuel/air mixture and flowing flames, and resulting hot combustion gases, into said inlet of said heat exchanger means, said fuel burner means having an inlet into which combustion air may be drawn, and draft inducer fan means having an inlet connected to said heat exchanger means outlet, and further having an outlet, said draft inducer fan means being operable to draw combustion air into said fuel burner means inlet, and to draw combustion gases through said heat exchanger means and then discharge the combustion gases, said draft inducer fan means, during operation thereof, creating a pressure differential between said heat exchanger means inlet and said draft inducer fan means outlet; and venting and intake means for simultaneously flowing outside combustion air to said fuel burner means inlet and flowing discharged combustion gases to the outside of the building, in response to operation of said fuel burner means and said draft inducer fan means, in a manner rendering said pressure differential substantially insensitive to variations in outside wind direction and velocity, said venting and intake means including:

vent pipe means operative to flow combustion gases discharged from said draft inducer means to the exterior of the building, said vent pipe means having an inner end connected to said draft inducer means outlet, and an essentially straight outer end portion axially extending horizontally outwardly through said exterior wall and having an open, uncovered outer end, spaced horizontally outwardly from the outside surface of said exterior wall, through which combustion gases may be discharged directly to atmosphere in an axially outward direction, first inlet pipe means axially extending horizontally outwardly through said exterior wall in an outwardly concentric relationship with said outer end portion of said vent pipe means and defining therewith an annular flow space, said first inlet pipe means having an open, uncovered horizontally outwardly facing outer end, positioned between said outer end of said vent pipe means and the outside surface of said exterior wall, through which outside combustion air may directly enter in an axially inward direction and pass into said annular flow space, and second inlet pipe means, interconnected between said first inlet pipe means and said fuel burner means inlet, for communicating said annular flow space with said fuel burner means inlet.

2. The apparatus of claim 1 wherein:

said furnace is a high efficiency condensing furnace, said heat exchanger means include a primary heat exchanger connected in series to a secondary heat exchanger, said heat exchanger means inlet is positioned on said primary heat exchanger, said heat exchanger means outlet is positioned on said secondary heat exchanger, and said venting and intake means are formed from a plastic material.

3. The apparatus of claim 2 wherein:

said venting and intake means are formed from PVC plastic pipe and PVC plastic pipe fittings.

4. Apparatus for heating at least a portion of a building having an exterior wall, said apparatus comprising:

a fuel-fired induced draft high efficiency condensing furnace disposed in said building and including:

heat exchanger means for receiving an internal throughflow of hot combustion gases, said heat exchanger means having an inlet and an outlet and including a primary heat exchanger connected in series to a secondary heat exchanger, said heat exchanger means inlet being positioned on said primary heat exchanger, said heat exchanger means outlet being positioned on said secondary heat exchanger, fuel burner means for receiving a fuel/air mixture and flowing flames, and resulting hot combustion gases, into said inlet of said heat exchanger means, said fuel burner means having an inlet into which combustion air may be drawn, and draft inducer fan means having an inlet connected to said heat exchanger means outlet, and further having an outlet, said draft inducer fan means being operable to draw combustion air into said fuel burner means inlet, and to draw combustion gases through said heat exchanger means and then discharge the combustion gases, said draft inducer fan means, during operation thereof, creating a pressure differential between said heat exchanger means inlet and said draft inducer fan means outlet; and venting and intake means for simultaneously flowing outside combustion air to said fuel burner means inlet and flowing discharged combustion gases to the outside of the building, in response to operation of said fuel burner means and said draft inducer fan means, in a manner rendering said pressure differential substantially insensitive to variations in outside wind direction and velocity, said venting and intake means being formed from PVC plastic pipe and PVC plastic pipe fittings and including:

vent pipe means operative to flow combustion gases discharged from said draft inducer means to the exterior of the building, said vent pipe means having an inner end connected to said draft inducer means outlet, and an essentially straight outer end portion axially extending horizontally outwardly through said exterior wall and having an open, uncovered outer end, spaced horizontally outwardly from the outside surface of said exterior wall, through which combustion gases may be discharged directly to atmosphere in an axially outward direction, first inlet pipe means axially extending horizontally outwardly through said exterior wall in an outwardly concentric relationship with said outer end portion of said vent pipe means and defining therewith an annular flow space, said first inlet pipe means having an open, uncovered horizontally outwardly facing outer end, positioned between said outer end of said vent pipe means and the outside surface of said exterior wall, through which outside combustion air may directly enter in an axially inward direction and pass into said annular flow space, and second inlet pipe means, interconnected between said first inlet pipe means and said fuel burner means inlet, for communicating said annular flow space with said fuel burner means inlet, said first inlet pipe means including:

a length of PVC plastic pipe having an outer end adjacent the outside surface of said exterior wall, and an inner end portion adjacent the inside surface of said exterior wall;

a PVC plastic wye fitting having an interior communicating with said annular flow space, a first end receiving and adhering to said inner end portion of said length of PVC plastic pipe, a second end spaced apart from said first end, and an angled side portion connected to said second inlet pipe means, an annular PVC plastic bushing member received and adhered within said second end of said PVC plastic wye fitting, said plastic bushing member having an annular interior surface closely receiving and adhered to a portion of said vent pipe means, and a PVC plastic coupling member having a cylindrical first end portion telescopingly adhered to said outer end of said length of said PVC plastic pipe, and a radially enlarged second cylindrical end portion projecting outwardly beyond the outside surface of said exterior wall generally concentrically with said outer end portion of said vent pipe means.

5. A method of constructing a horizontal vent termination assembly at an exterior wall of a building served by a fuel fired furnace, said vent termination assembly being useable in simultaneously flowing outside combustion air to the furnace and ejecting combustion gases discharged therefrom to the outside of the building, said method comprising the steps of:

forming a generally circular opening through said exterior wall between its inside and outside surfaces;

providing a plastic combustion air inlet pipe having a length longer than the thickness of said exterior wall;

extending said combustion air inlet pipe horizontally through said exterior wall in a manner positioning a first end portion of said combustion air inlet pipe adjacent the outside surface of said exterior wall, with a second end portion of said combustion air inlet pipe projecting inwardly beyond the inside surface of said exterior wall;

providing a plastic wye fitting having a first cylindrical end, a second cylindrical end spaced apart from said first cylindrical end, and an angled side portion sloping outwardly toward said second cylindrical end;

cementing said second end portion of said combustion air inlet pipe within said first cylindrical end of said wye fitting;

providing a generally cylindrical plastic bushing member having an annular radially inner side surface with a diameter less than the internal diameter of said combustion air inlet pipe;

cementing said bushing member within said second cylindrical end of said wye fitting;

providing a plastic combustion gas vent pipe having a length longer than that of said combustion air inlet pipe, said bushing member being configured to permit sliding passage of said combustion gas vent pipe completely therethrough;

providing a plastic coupling member having a first cylindrical end sized to closely receive said first end portion of said combustion air inlet pipe, and a second, larger diameter cylindrical end;

cementing said first end portion of said combustion air inlet pipe within said first cylindrical end of said coupling member, with said second cylindrical end of said coupling member projecting outwardly beyond the outside surface of said exterior wall coaxially disposing said combustion gas vent pipe within said combustion air inlet pipe in a manner such that said combustion air inlet pipe and said combustion gas vent pipe define therebetween an annular combustion air flow space communicated with the interior of said wye fitting, a first end portion of said combustion gas vent pipe extends outwardly through the interior of said bushing member, and a second end portion of said combustion gas vent pipe extends outwardly through and beyond said second cylindrical end of said coupling member, the interior of said coupling member being configured to communicate said annular combustion flow space with the interior of said second cylindrical end of said coupling fitting;

cementing said first end portion of said combustion gas vent pipe within said bushing member; and leaving said second cylindrical end of said coupling member and said second end portion of said combustion gas vent pipe uncovered so as to permit direct, unimpeded, axially inward entry of outside combustion air into said second cylindrical end of said coupling member, and direct, unimpeded, axially outward discharge of combustion gases from said second end of said combustion gas vent pipe.

6. A vent termination assembly constructed by the method of claim 5.

7. The method of claim 5 wherein said vent termination assembly is constructed using PVC plastic pipe and PVC plastic fittings.

8. A vent termination assembly constructed by the method of claim 7.

9. The method of claim 7 wherein:

said step of providing a plastic bushing member is performed by providing a PVC plastic bushing fitting having a first annular interior stop portion, and removing said first stop portion to form said plastic bushing member, and said step of providing a plastic coupling member is performed by providing a PVC plastic coupling fitting having a second annular interior stop portion, and removing at least a major radial portion of said second stop portion to form said plastic coupling member.

10. A vent termination assembly constructed by the method of claim 9.

11. The method of claim 7 further comprising the step of:

positioning said angled side portion of said wye fitting above the balance of said wye fitting.

12. A vent termination assembly constructed by the method of claim 11.

13. A horizontal vent termination assembly for use in simultaneously flowing outside combustion air to a fuel fired furnace disposed in a building having an exterior wall and ejecting combustion gases discharged from the furnace to the outside of the building, said horizontal vent termination assembly comprising:

combustion gas vent pipe means for receiving and ejecting combustion gases discharged from the furnace, said combustion gas vent pipe means having an open discharge end positionable to extend horizontally outwardly beyond the outside surface of said exterior wall, said open discharge end being uncovered so as to permit direct, unimpeded axially outward discharge of combustion gases therethrough to the outside of the building; and combustion air inlet pipe means concentrically disposed outwardly around said combustion gas vent pipe means and defining therewith an annular flow space operative to receive a horizontally inward flow of outside combustion air, said combustion air inlet pipe means having an open inlet end outwardly circumscribing said combustion gas vent pipe means axially inwardly of said open discharge end thereof, said open inlet end of said combustion air inlet pipe means being positionable outwardly adjacent the outside surface of said exterior wall to receive an inflow of outside combustion air into said annular flow space, said open inlet end of said combustion air inlet pipe means being uncovered so as to permit a direct, unimpeded axially inward flow of outside combustion air therethrough.

14. The horizontal vent termination assembly of claim 13 wherein said horizontal vent termination assembly is formed from a PVC plastic material.

15. The horizontal vent termination assembly of claim 14 wherein said combustion air inlet pipe means include:

a length of PVC plastic pipe having an outer end, and a PVC plastic coupling member having a first cylindrical end within which said outer end of said length of PVC plastic pipe is received and cemented, and a second, larger diameter second cylindrical end defining said open inlet end of said combustion air inlet pipe means.

16. A horizontal vent termination assembly for use in simultaneously flowing outside combustion air to a fuel fired furnace disposed in a building having an exterior wall and ejecting combustion gases discharged from the furnace to the outside of the building, said horizontal vent termination assembly being formed form a PVC plastic material and comprising:

combustion gas vent pipe means for receiving and ejecting combustion gases discharged from the furnace, said combustion gas vent pipe means having an open discharge end positionable to extend horizontally outwardly beyond the outside surface of said exterior wall, said open discharge end being uncovered so as to permit direct, unimpeded axially outward discharge of combustion gases therethrough to the outside of the building; and combustion air inlet pipe means concentrically disposed outwardly around said combustion gas vent pipe means and defining therewith an annular flow space operative to receive a horizontally inward flow of outside combustion air, said combustion air inlet pipe means having an open inlet end outwardly circumscribing said combustion gas vent pipe means axially inwardly of said open discharge end thereof, said open inlet end of said combustion air inlet pipe means being positionable outwardly adjacent the outside surface of said exterior wall to receive an inflow of outside combustion air into said annular flow space, said open inlet end of said combustion air inlet pipe means being uncovered so as to permit a direct, unimpeded axially inward flow of outside combustion air therethrough, said combustion air inlet pipe means including:

a length of PVC plastic pipe having an outer end, and a PVC plastic coupling member having a first cylindrical end within which said outer end of said length of PVC plastic pipe is received and cemented, and a second, larger diameter second cylindrical end defining said open inlet end of said combustion air inlet pipe means, said PVC coupling member being a standard PVC plastic coupling fitting from which at least a major radial portion of the annular interior stop portion thereof has been removed.

* * * * *